US007204099B2

(12) United States Patent
Lifson et al.

(10) Patent No.: US 7,204,099 B2
(45) Date of Patent: Apr. 17, 2007

(54) REFRIGERANT SYSTEM WITH VAPOR INJECTION AND LIQUID INJECTION THROUGH SEPARATE PASSAGES

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 192 days.

(21) Appl. No.: 11/151,570

(22) Filed: Jun. 13, 2005

(65) Prior Publication Data

US 2006/0277941 A1 Dec. 14, 2006

(51) Int. Cl.
*F25B 41/00* (2006.01)

(52) U.S. Cl. ..... 62/513

(58) Field of Classification Search ..... 62/113, 62/174, 196.1, 197, 513, 228.3, 505, 510, 62/228.5, 223

See application file for complete search history.

(56) References Cited

U.S. PATENT DOCUMENTS 3,108,453 A * 10/1963 Tinkey ..... 62/200
3,913,346 A * 10/1975 Moody et al. ..... 62/197
4,261,180 A * 4/1981 Nozawa et al. ..... 62/202
5,095,712 A * 3/1992 Narreau ..... 62/113
5,768,901 A * 6/1998 Dormer et al. ..... 62/175
6,032,472 A * 3/2000 Heinrichs et al. ..... 62/199
6,167,722 B1 * 1/2001 Kasezawa et al. ..... 62/513
6,446,450 B1 * 9/2002 Pressler ..... 62/217
6,571,576 B1 * 6/2003 Lifson et al. ..... 62/513
6,718,781 B2 * 4/2004 Freund et al. ..... 62/199
6,739,147 B1 * 5/2004 Sishtla ..... 62/192
6,820,434 B1 * 11/2004 Gutheim et al. ..... 62/175
6,966,193 B2 * 11/2005 Dobmeier et al. ..... 62/196.2

FOREIGN PATENT DOCUMENTS

JP 9-178274 A * 7/1997

* cited by examiner

*Primary Examiner*—Mohammad M. Ali
(74) *Attorney, Agent, or Firm*—Carlson, Gaskey & Olds

(57) ABSTRACT

A refrigerant system is provided with economizer vapor injection and liquid injection functions. As is known, the economizer function enhances performance of the refrigerant system. The liquid injection lowers the discharge temperature of the refrigerant to provide reliable compressor/system operation. The liquid injection and economizer vapor injection functions are selectively provided through distinct fluid passages leading to separate compression pockets. Single or dual pocket injection scheme could be utilized in conjunction with either function. The location of the liquid injection is preferably downstream in the compression process in relation to the economizer vapor injection. In this manner, a refrigerant system designer can select the optimal location of injection for each of the two refrigerant flows. The refrigerant system can consists of a single compressor or multiple compressors either connected in series or in parallel.

20 Claims, 3 Drawing Sheets

REFRIGERANT SYSTEM WITH VAPOR INJECTION AND LIQUID INJECTION THROUGH SEPARATE PASSAGES

BACKGROUND OF THE INVENTION

This application relates to a refrigerant system having a compressor or multiple compressors receiving both an intermediate pressure vapor injection, and a liquid injection, with the two injection flows being delivered through two distinct passages.

Refrigerant systems are utilized in many applications to condition an environment. In particular, air conditioners and heat pumps are employed to cool and/or heat air entering an environment. The cooling or heating load of the environment may vary with ambient conditions, occupancy level, other changes in sensible and latent load demands, and as the temperature and/or humidity set points are adjusted by an occupant of the environment.

One of the options available to a refrigerant system designer to enhance system performance (capacity and/or efficiency) is a so-called economizer cycle. In the economizer cycle, a portion of the refrigerant flowing from the condenser is tapped and passed through an economizer expansion device and then to an economizer heat exchanger. This tapped refrigerant flow subcools a main refrigerant flow that also passes through the economizer heat exchanger. The tapped refrigerant flow leaves the economizer heat exchanger, usually in a vapor state, and is injected back into the compressor at an intermediate compression point. In an alternate arrangement, a flash tank can be utilized in place of the economizer heat exchanger to provide similar functionality (in essence, the flash tank could be considered as a 100% effective economizer heat exchanger). The subcooled main refrigerant flow exiting the condenser is additionally subcooled after passing through the economizer heat exchanger. The main refrigerant flow then passes through a main expansion device and an evaporator. This main refrigerant flow will have a higher cooling potential because it was additionally subcooled in the economizer heat exchanger. An economizer cycle thus provides enhanced system performance. In an alternate arrangement, a portion of the refrigerant flow is tapped and passed through the economizer expansion device after being passed through the economizer heat exchanger (along with the main flow). In all other aspect this economizer heat exchanger arrangement is identical to the configuration described above.

The economizer function typically includes the tapped refrigerant flow being injected back into compression chambers at an intermediate pressure point.

Another option in refrigerant systems is the injection of liquid refrigerant flow into compression chambers to reduce operating temperature of the compressor and to provide its reliable operation.

Refrigerant systems are known where both the economized vapor and liquid injection are performed. However, the two flows have typically been passed back into a compressor through a single fluid line and internal compressor passages.

However, a compressor designer would like to have the freedom of directing the economized refrigerant to a location that is preferred for the economizer injection function from the performance boost perspective, and at the same time, directing the liquid refrigerant to a location that is preferred for its injection from the reliability enhancement point of view for reduction of the discharge temperature.

SUMMARY OF THE INVENTION

In a disclosed embodiment of this invention, liquid and economized vapor are injected back into a compressor through separate lines and internal compressor passages. The liquid and economized vapor are preferably injected into separate compression chambers. The liquid injection can be in sequential or parallel arrangement with respect to the vapor injection.

The vapor injection may occur into two compression chambers that are running in parallel with each other, while, for example, the liquid injection would only be occurring in one of the chambers. Typically, the liquid injection would occur downstream of the vapor injection. Other configurations, such as vapor injection in a single compression pocket with a liquid injection in two parallel pockets located downstream, are also feasible.

In one embodiment, the compressor is a tri-rotor screw compressor, and in a second embodiment, the compressor is a scroll compressor. However, this arrangement can be applied to other configurations as, for example, twin screws where the vapor injection will occur into the screw compression pockets. This arrangement can also be applied to several compressors connected in series or parallel. For example, the liquid injection can be done into the connecting line between the two compressors operated in series and the vapor injection can be accomplished into the compression pocket of the first compressor. When the compressors are connected in parallel the liquid and vapor injection can be carried out in a similar fashion as it is done into the compression pockets of the tri-rotor configurations that are operating in parallel.

These and other features of the present invention can be best understood from the following specification and drawings, the following of which is a brief description.

DETAILED DESCRIPTION OF THE PREFERRED EMBODIMENT

Figure 1A:
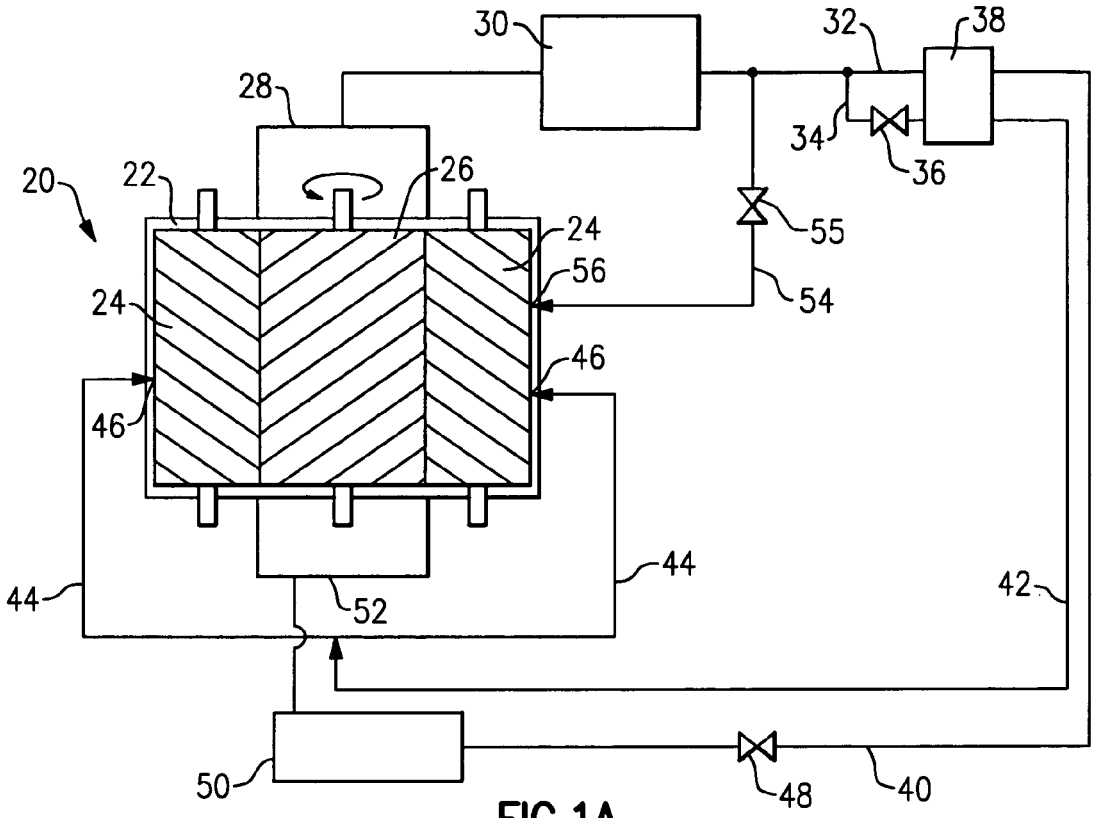
FIG. 1A is a schematic view of a refrigerant system with a tri-rotor screw compressor according to the present invention.

A refrigerant system 20 is illustrated in FIG. 1A. Refrigerant system 20 includes a compressor 22, which is shown as a tri-rotor screw compressor. Normally, the driven screw rotors 24 are placed on opposed sides of a drive screw 26. As known, the drive screw 26 is driven by an electric motor (not shown). The drive screw drives the driven screws 24. Compression chambers are defined between the screw flutes on the rotors 24 and 26. As also known, refrigerant having been compressed in the compression chambers between the rotors 24 and 26 passes into a discharge passage 28 leading to a condenser 30. Downstream of condenser 30, a main refrigerant flow line 32, and a tapped refrigerant line 34 both pass through an economizer heat exchanger 38. The tapped flow in the line 34 passes through an auxiliary expansion device 36. As is known, the expanded (to lower pressure and temperature) refrigerant flow from the tap line 34 subcools the main flow of refrigerant in the line 32.

The main flow of refrigerant passes downstream through a line 40, through a main expansion device 48, and to an evaporator 50. From the evaporator 50, the main flow of refrigerant returns through a suction line 52 back to the compressor 22. The tapped refrigerant flow from the line 34 passes into a vapor injection line 42 downstream of the economizer heat exchanger 38. While both the tapped flow in the line 34 and the main flow in the line 32 are shown in the same direction through the economizer heat exchanger 38, in practice, the two flows are typically arranged in the counter-flow relationship. However, for illustration simplicity, they are shown flowing in the same direction here. It is assumed that an auxiliary expansion devise 36 can be equipped with shutoff capability to terminate economizer function when desired. Otherwise, an additional shutoff valve may be employed in the economizer circuit. As known, instead of the economizer heat exchanger a flash tank arrangement can be used as well.

The injection line 42 leads to an economizer injection passages 44 extending to two ports 46, with the ports 46 associated with each of two parallel compression chambers between the drive rotor 26 and each of the driven rotors 24. Economizer vapor flow is injected into the compression chambers through the ports 46 at some intermediate (between suction and discharge) pressure.

Figure 1B:
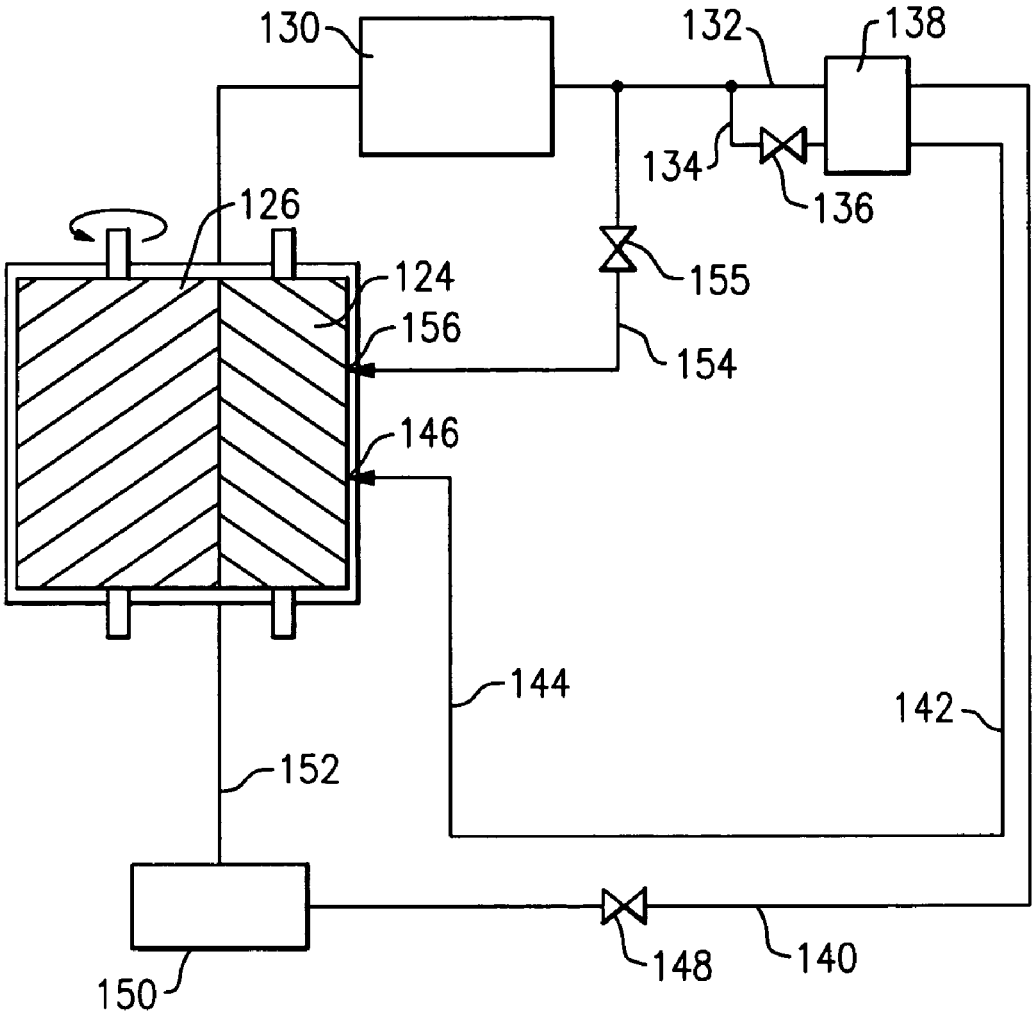
FIG. 1B is an alternate schematic of a refrigerant system with a twin-rotor screw compressor according to the present invention.

At the same time, liquid refrigerant may be tapped off from a location, such as downstream of the condenser 30, and returned through a line 54 and a flow control device 55 to a port 56 and back into the compression chambers. As shown, the liquid injection could be associated with one of the of the two compression chambers. Moreover, as is clear from FIG. 1, the liquid injection is preferably positioned downstream of the vapor injection. While the right-hand side of the illustration in FIG. 1 shows the port 56 sequentially downstream of the right-hand port 46, it may also be true that only a single injection port 46 is utilized on the left-hand side. That is, the two injections can simply be in the parallel chambers on opposed sides of the compressor 22 but preferably at different points in the compression process (with liquid injection preferably downstream in relation to vapor injection). Flow control device 55 provides a shutoff function when liquid injection is not required and controls refrigerant flow impedance for a proper injection process. Further, it has to be understood that the benefits of the invention could be equally applicable to the twin-rotor screw compressor as shown in FIG. 1B. The elements in FIG. 1B are all similar to the corresponding elements in FIG. 1A, except their reference numerals have been increased by 100.

Figure 2:
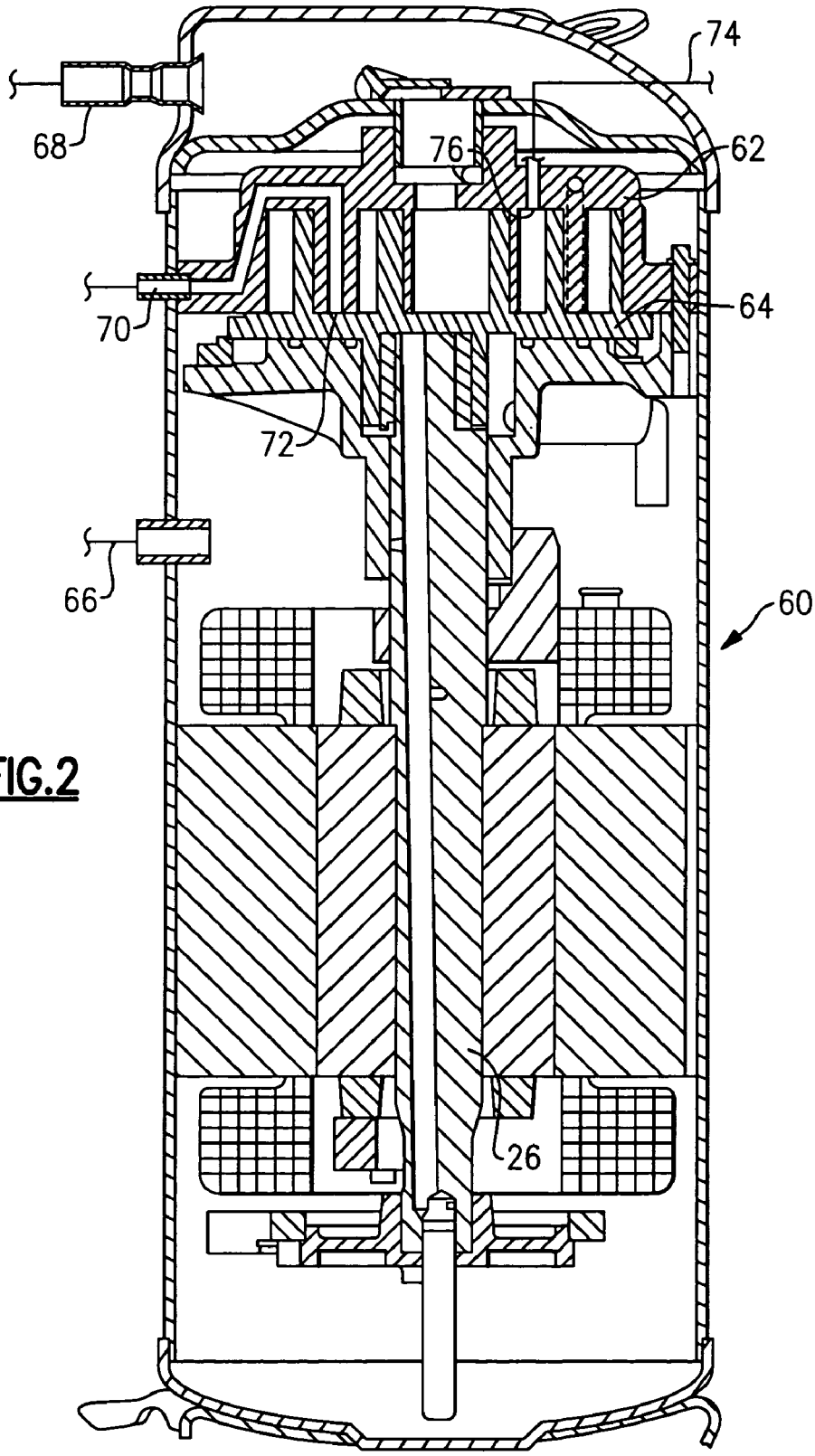
FIG. 2 shows a cross-sectional view of a scroll compressor according to the present invention.

FIG. 2 shows another embodiment 60, wherein a scroll compressor is utilized rather than a screw compressor. As known, an orbiting scroll member 64 orbits relative to a non-orbiting scroll member 62. A suction line 66 receives refrigerant from the evaporator, and a discharge line 68 directs the refrigerant to the condenser. As shown in FIG. 2, an economizer vapor injection line 70 extends to ports 72, while the liquid injection is provided through a line 74 to a port 76. As is clear from FIG. 2, the port 76 is downstream of the port 72. The line 74 and port 76 are shown highly schematically in the drawing. Of course, appropriate routing structure with necessary seal elements, etc. would be included, as known. Once again, various combinations of vapor and liquid injection into a single and dual compression pockets are feasible.

Figure 3:
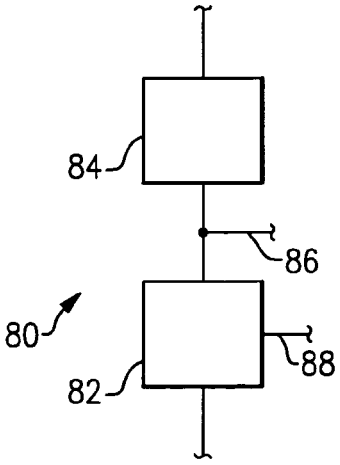
FIG. 3 shows two compressors connected in series.

FIG. 3 shows another embodiment 80 wherein there are two stages of compression 82 and 84. As shown, one option provided by the present invention includes the vapor injection at line 88 into the first stage compressor 82, and the liquid injection through line 86 intermediate the first stage 82 and second stage 84 compressors. Other configurations such as the vapor injection accomplished in between the compression stages 82 and 84 and the liquid injection carried out into the compression pocket (or pockets) of the second compression stage 84 are also feasible.

Figure 4:
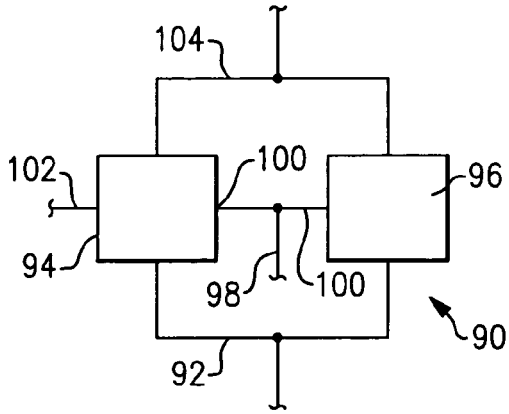
FIG. 4 shows two compressors connected in parallel.

FIG. 4 shows another embodiment 90 wherein a single suction line 92 leads to two parallel compressors 94 and 96. Again, the present invention provides several options such as injecting the vapor through a line 98 leading through lines 100 to each of the compressors 94 and 96 in parallel. On the other hand, liquid may be injected through line 102 into only one of the compressors 94, preferably downstream from the vapor injection point. Of course, the liquid could be injected into both compressors 94 and 96. A single discharge line 104 leads downstream from the compressors 94 and 96.

While preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

at least one compressor delivering refrigerant downstream to a condenser, an economizer heat exchanger downstream of said condenser, a main flow line passing from said condenser through said economizer heat exchanger, a tap line being tapped off said main flow line and passing a tapped flow of refrigerant through said economizer heat exchanger to cool refrigerant in said main flow line, said tapped flow being returned into at least one intermediate compression pocket into said at least one compressor;

said refrigerant in said main flow line passing through a main expansion device and an evaporator and then back to said at least one compressor; and said tapped flow being returned to said at least one compressor through an economizer injection line, and a liquid refrigerant being injected into said at least one compressor through a liquid injection line, with said liquid injection line and said economizer injection line being separate fluid lines.

2. The refrigerant system as set forth in claim 1, wherein said at least one compressor is a screw compressor.

3. The refrigerant system as set forth in claim 2, wherein said screw compressor is a tri-rotor screw compressor.

4. The refrigerant system as set forth in claim 2, wherein said screw compressor is a twin-rotor screw compressor.

5. The refrigerant system as set forth in claim 1, wherein said at least one compressor is a scroll compressor.

6. The refrigerant system as set forth in claim 1, wherein said liquid refrigerant is injected into said at least one compressor through at least one injection port located downstream of at least one economizer injection port for said tapped flow.

7. The refrigerant system as set forth in claim 1, wherein there are two economizer injection ports receiving refrigerant from said economizer injection line.

8. The refrigerant system as set forth in claim 7, wherein there is only a single liquid injection port receiving refrigerant from said liquid injection line.

9. The refrigerant system as set forth in claim 1, wherein said liquid is taken from downstream of said condenser and injected into said at least one compressor.

10. The refrigerant system as set forth in claim 1, wherein said economizer injection line injecting at least some of said tapped flow into a compression chamber which is operating in parallel with a compression chamber receiving said liquid.

11. The refrigerant system as set forth in claim 1 wherein there are at least two compressors and the said economizer vapor injection line is connected to a line connecting the said at least two compressors.

12. The refrigerant system as set forth in claim 1 wherein there are at least two compressors and the said liquid injection line is connected to a line connecting the said at least two compressors.

13. The refrigerant system as set forth in claim 1, wherein there are two compressors operating in parallel, and the economizer vapor injection line is connected to both of said two compressors, with said liquid injection line only connecting to one of said compressors.

14. The refrigerant system as set forth in claim 9, wherein said tapped economizer flow being injected through two injection ports, with one of said injection ports being delivered into said first compression chamber, upstream of an injection point of said liquid.

15. A refrigerant system comprising:

at least one compressor delivering refrigerant downstream to a condenser, an economizer heat exchanger downstream of said condenser, a main flow line passing from said condenser through said economizer heat exchanger, a tap line being tapped off said main flow line and passing a tapped flow of refrigerant through said economizer heat exchanger to cool refrigerant in said main flow line, said tapped flow being returned into at least one intermediate compression point in said at least one compressor;

said refrigerant in said main flow line passing downstream through a main expansion device and an evaporator back to said at least one compressor;

said tapped flow being returned to said at least one compressor through an economizer injection line, and a liquid refrigerant being injected into said at least one compressor through a liquid injection line, with said liquid injection line and said economizer injection line being separate fluid lines; and said at least one compressor being a tri-rotor screw compressor, said liquid refrigerant being injected into a first compression chamber defined between a first driven rotor of said tri-rotor screw compressor and a drive rotor, and at least some of said tapped flow being injected into a second compression chamber defined between a second driven rotor of said tri-rotor screw compressor and the drive rotor with said first and second compression chambers operating in parallel.

16. The refrigerant system as set forth in claim 15, wherein said liquid is taken from downstream of said condenser and injected into said at least one compressor.

17. The refrigerant system as set forth in claim 15, wherein said liquid is taken from downstream of said condenser and injected into said at least one compressor.

18. A refrigerant system comprising:

at least one compressor delivering refrigerant downstream to a condenser, an economizer heat exchanger downstream of said condenser, a main flow line passing from said condenser through said economizer heat exchanger, a tap line being tapped off said main flow line and passing a tapped flow of refrigerant through said economizer heat exchanger to cool refrigerant in said main flow line, said tapped flow being returned into at least one intermediate compression point in said at least one compressor;

said refrigerant in said main flow line passing downstream through a main expansion device and an evaporator back to said at least one compressor;

said tapped flow being returned to said at least one compressor through economizer injection line, and a liquid refrigerant being injected into said at least one compressor through a liquid injection line, with said liquid injection line and said economizer injection line being separate fluid lines; and said at least one compressor being a scroll compressor, and said liquid refrigerant being injected into a first compression chamber, and at least some of said tapped flow being injected into a parallel second compression chamber.

19. The refrigerant system as set forth in claim 18, wherein said tapped flow being injected through two injection ports, with one of said injection ports being delivered into said first compression chamber, upstream of an injection point of said liquid.

20. The refrigerant system as set forth in claim 18, wherein said tapped economizer flow being injected through two injection ports, with one of said injection ports being delivered into said first compression chamber, upstream of an injection point of said liquid.

* * * * *